United States Patent [19]

Hoyland

[11] 3,971,191

[45] July 27, 1976

[54] MACHINE FOR INSERTING OBJECTS INTO BAGS

[75] Inventor: Trevor Barrie Hoyland, Norwich, England

[73] Assignee: Thurne Engineering Company Limited, Norwich, England

[22] Filed: July 11, 1975

[21] Appl. No.: 594,972

[52] U.S. Cl. ..... 53/112 B; 53/189; 53/258; 53/370

[51] Int. Cl.[2] ..... B65B 7/12; B65B 31/06; B65B 43/36; B65B 51/08

[58] Field of Search ..... 53/189, 112 B, 370, 53/266, 258

[56] References Cited

UNITED STATES PATENTS

| | | | |
|---|---|---|---|
| 2,746,225 | 5/1956 | Cloud | 53/370 |
| 3,208,193 | 9/1965 | Rumsey, Jr. | 53/112 B |
| 3,369,341 | 2/1968 | Niedecker | 53/112 B |
| 3,490,195 | 1/1970 | Abramson | 53/189 X |
| 3,491,514 | 1/1970 | Burford | 53/189 |
| 3,538,671 | 11/1970 | Wallace | 53/189 X |
| 3,624,982 | 12/1971 | Marietta, Jr. | 53/112 B X |
| 3,827,210 | 8/1974 | Smalley et al. | 53/112 B |

*Primary Examiner*—Travis S. McGehee
*Assistant Examiner*—Horace M. Culver
*Attorney, Agent, or Firm*—Sughrue, Rothwell, Mion, Zinn & Macpeak

[57] ABSTRACT

A machine for inserting objects, for example chickens or other comestibles, into bags, comprises a holder for a stack of bags, an object support which is movable to and fro between a forward position in which, in use, is inserted together with an object supported on it, into a bag, and a retracted position, a device having pushing means operable to engage the object on the support and push it forwards from the support and at the same time cause the bag to move forwards from the holder. The device is arranged subsequently to withdraw the pushing means, and the machine also includes means for pressing the bag inwards into contact with a part of the pushing means behind the object, a suction connection associated with the pushing means for sucking air from the bag after the bag has been pressed into contact with the part of the pushing means, and means for closing the bag after it has had air sucked from it. Preferably the machine has a first and a second pusher, the first pusher, in use, engaging the object and pushing it forwards from the support and the second pusher being associated with a suction connection so that when the means for pressing the bag inwards presses the bag inwards into contact with the second pusher the suction connection sucks air from the bag.

6 Claims, 9 Drawing Figures

MACHINE FOR INSERTING OBJECTS INTO BAGS

This invention is concerned with a machine which inserts objects, for example chickens or other comestibles, into bags and which removes air from the bags before closing them.

Previously such objects have been packaged manually. An operator takes a bag, opens it and then inserts the object into it. The operator then removes as much air as possible by manipulating the bag and the object and engaging the bag tightly against the object. The operator then closes and seals the bag. This invention provides a machine to carry out this process automatically which gives better results by removing more air from the filled bag before closing it.

According to this invention a machine for inserting objects into bags comprises a holder for a stack of bags, an object support which is movable to and fro between a forward position in which, in use, it is inserted together with an object supported on it, into a bag, and a retracted position, a device having pushing means operable to engage the object on the support and push it forwards from the support and at the same time cause the bag to move forwards from the holder, the device also being arranged subsequently to withdraw the pushing means, means for pressing the bag inwards into contact with a part of the pushing means behind the object, a suction connection associated with the pushing means for sucking air from the bag after the bag has been pressed into contact with the part of the pushing means, and means for closing the bag after it has had air sucked from it.

The device may include a single pusher which is arranged to engage the object on the support and push it forwards from the support, the means for pressing the bag inwards pressing the bag into contact with the pusher behind the object, and the suction connection being associated with the pusher for sucking air from the bag after it has been pressed into contact with the pusher. In this case the single pusher is preferably rotatable and the device includes a rotary drive, the pusher and device being arranged so that after the bag has had air sucked from it the rotary drive rotates the pusher and with it the neck of the bag to twist and close the neck of the bag and allow it to be sealed more easily.

Preferably however the device includes two pushers the first of which engages the object on the support and pushes it forwards from the support and second of which includes a suction connection and is arranged to take over from the first, to be present behind the object so that the bag can be pressed inwards into contact with it. Preferably the second pushed is rotatable and the device includes a rotary drive, and, in this case, after the bag has had air sucked from it through the second pusher the rotary drive rotates the second pusher and with it the neck of the bag to twist and close the neck of the bag and allow it to be sealed more easily. It has been found that the rate of packing of a machine having two pushers is nearly double that of a machine having a single pusher.

A particular example of a machine in accordance with this invention which is arranged to insert dressed chickens into bags made from a plastics material will now be described with reference to the accompanying drawings; in which.

Figure 1:
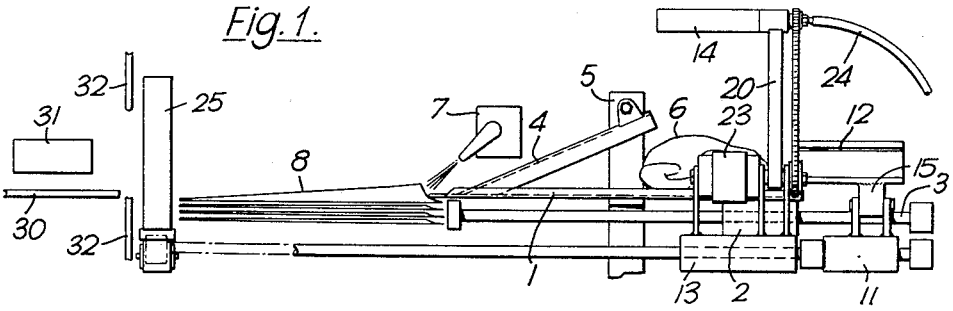
FIG. 1 is a somewhat diagrammatic side elevation of the machine at the start of a packing cycle.
Figure 2:
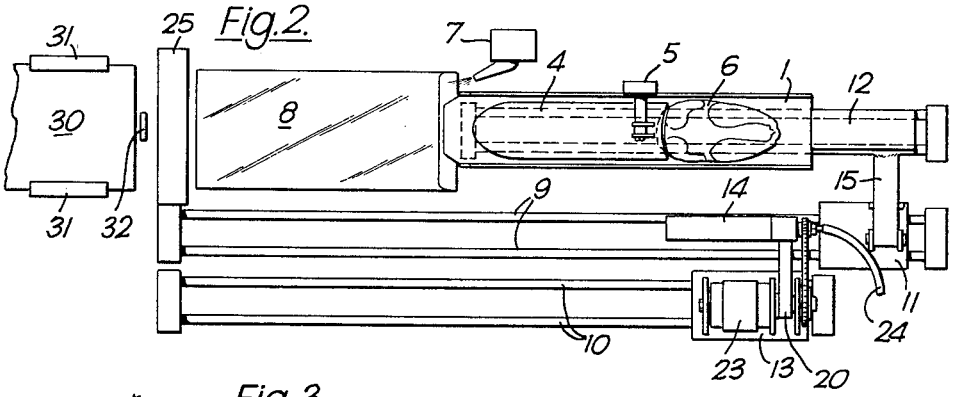
FIG. 2 is a diagrammatic plan of the machine at the start of a packing cycle.

The machine includes an elongated support table 1 the rear end of which is fixed to a carriage 2 which is movable backwards and forwards along a pair of guide bars 3 under the control of a driving mechanism (not shown). A rectangular flap 4 is pivotally connected to an upright post 5, the bottom of which is fixed to the table 1. The forward edge of the flap 4 normally rests near to, but just behind, the front edge of the support table 1 and thus the flap is normally inclined to the horizontal. The rear edge of the flap 4 is arranged at a height sufficient to allow a dressed chicken 6 to pass between the rear edge of the flap 4 and the table 1.

A wicket of gusseted polythene bags is positioned in front of the pair of guide bars 3, this wicket may be formed in accordance with our copending United Kingdom Patent Application No. 15472/74. But in this machine the wicket comprises a stack of gusseted bags each of which includes a flap having two holes punched through it, a pair of rods extend through the holes in the flaps of the bags and the rods include a crossbar between their upper ends to retain the bags on the rods. The wicket also includes biasing means (not shown) to urge the stack of bags upwards against the crosspiece at the top of the two rods.

A nozzle 7 blows a stream of air over the stack of bags and this stream of air lifts the upper surface of the top bag 8 in the stack to partially open the bag 8. The remaining bags in the stack are prevented from opening by the flap of the top bag 8 which is held by the two rods and the crosspiece. The stack of bars is arranged so that when the front edge of the table 1 is in its rearmost position it is clear of the stack and when the front edge of the table 1 is in its advanced position it is adjacent the closed ends of the bags in the stack.

Figure 7:
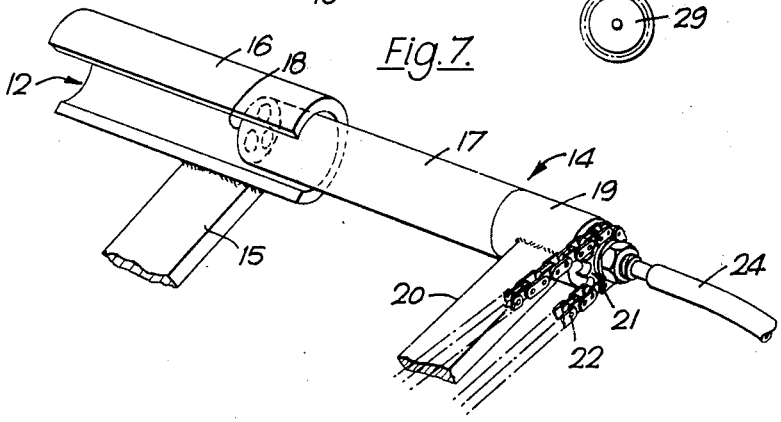
FIG. 7 is a perspective view of the two pushers.

Alongside the pair of guide bars 3 are two further pairs of guide bars 9 and 10. Both pairs of bars 9 and 10 extend forwards to the closed end of the bags in the stack of bags. A carriage 11, which is movable along the pair of bars 9, carries a first pusher 12 and a carriage 13, which is movable along the pair of guide bars 10, carries a second pusher 14. The pushers 12 and 14 are shown best in FIG. 7. The first pusher 12 includes an arm 15 one end of which is pivotally mounted on the carriage 11 and the other end of which is attached to a hollow generally cylindrical body 16. The body 16 includes a longitudinal slot. The second pusher 14 has a cylindrical body 17 having a perforated front face 18 and is rotatably mounted in a journal 19 which is fixed to one end of an arm 20. The other end of the arm 20 is pivotally mounted on the carriage 13. A sprocket 21 is attached to the body 17 of the second pusher 14 and a driving chain 22 is engaged with the sprocket 21. The driving chain 22 is driven by a motor 23 mounted on the carriage 13 so that the motor 23 rotates the body 17 of the second pusher 14. The interior of a pipe 24 is in communication with the inside of the body 17 and its perforated face 18. The pipe 24 is connected to a source of suction to suck air through the perforations in the face 18 of the pusher 14, through the body of the pusher 14 and then through the pipe 24. The arms 15 and 20 each include a mechanism to pivot them with respect to their associated carriages and further mechanisms are also provided to move the carriages 11 and 13 along the guide bars 9 and 10. Details of these are not shown but the mechanism to pivot the arms 15 and 20 with respect to their carriages 11 and 13 each includes a pneumatic piston and cylinder.

Figure 8:
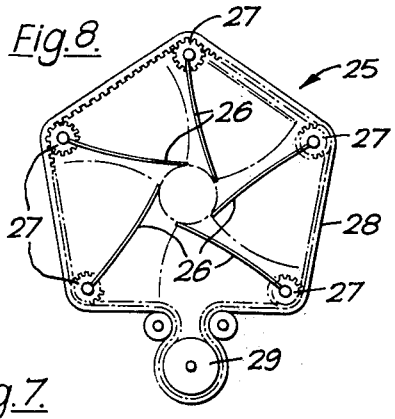
FIG. 8 is a diagrammatic view of the bag closing fingers and their operating mechanism; and, FIG. 9 is a front elevation showing the pivoting action of the pushers.

Means 25 for pressing the bags inwards are provided in front of the stack of bags. These means 25 may be formed by an annular brush having its tufts directed inwards towards its centre but, for hygenic reasons, this is not preferred and means illustrated more clearly in FIG. 8 are used. These comprise five fingers 26 made from resilient plastics strip which are fixed to toothed wheels 27. A toothed driving belt 28 engages the toothed wheels 27 and is driven by a toothed wheel 29. The driving wheel 29 is arranged to rotate through a limited angle in one direction and then counter-rotate through a limited angle in the opposite direction. This movement causes the toothed belt 28 to move forwards and backwards and in doing so move the fingers 26 from their position in solid lines to their position shown in dotted lines. Thus the fingers 26 act in a similar way to an iris diaphragm.

In front of the means 25 is a further table 30, a pair of jaws 31 and a pair of grippers 32.

Figure 3:
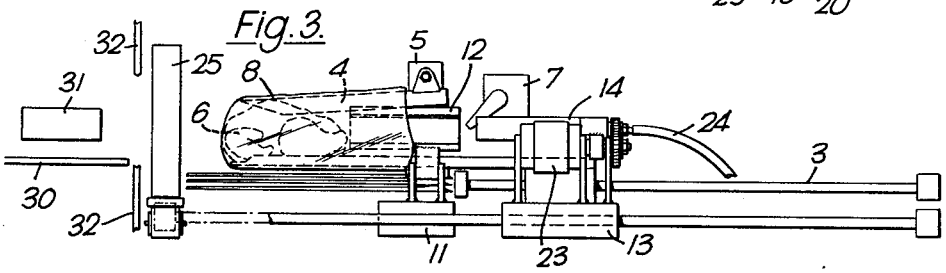
FIG. 3 is a view similar to FIG. 1 with the packing cycle partly completed.
Figure 4:
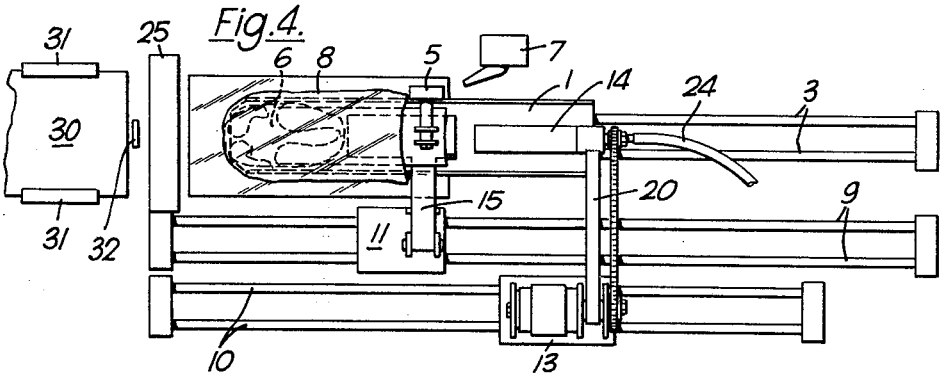
FIG. 4 is a view similar to FIG. 2 with the packing cycle partly completed.

Dressed chickens 6 are placed one at a time on the table 1 when it is in its rearmost position. This may be done by hand or they may be fed onto the table 1 from a belt conveyor leading from a chicken preparation line. A jet of air from the nozzle 7 partially opens the top bag 8 of the stack of bags and then the table 1 is moved forwards along the guide bars 3 so that its leading edge enters the partially opened bag 8. The first pusher 12 moves forward from its rearmost position following up behind the chicken 6 on the table 1. The pusher 12 moves faster than the table 1 and consequently catches up with the chicken 6 and starts to move it forwards along the table 1. When the table 1 is in its foremost position the pusher 12 starts to push the chicken 6 beneath the flap 4. This causes the flap 4 to pivot upwards and fully open the bag 8. The second pusher 14 pivots downwards so that it is generally aligned with the pusher 12 and begins to move forwards from its rearmost position. The pusher 12 continues to move forward until the chicken 6 is engaged with the closed end of the bag 8 and this is the position shown in FIGS. 3 and 4.

Figure 5:
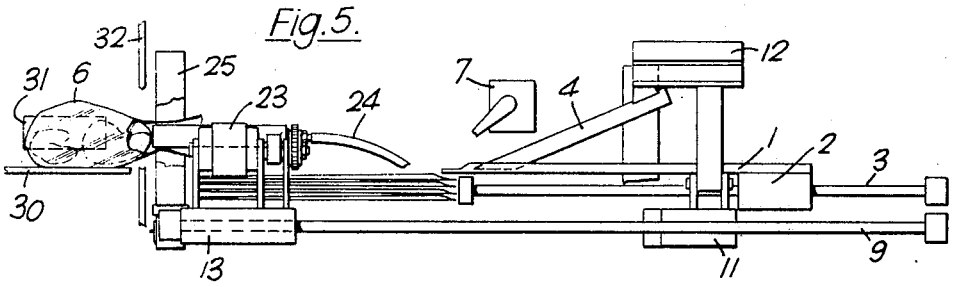
FIG. 5 is a further view similar to FIG. 1 just before the end of a packing cycle.
Figure 6:
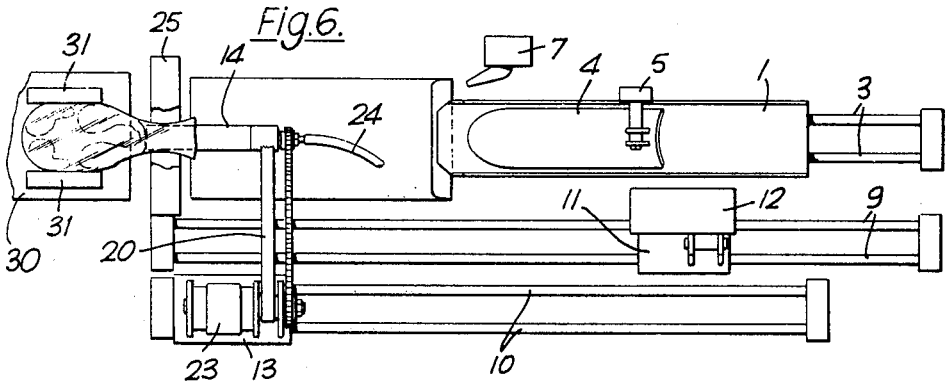
FIG. 6 is a view similar to FIG. 2 just before the end of a packing cycle.
Figure 9:
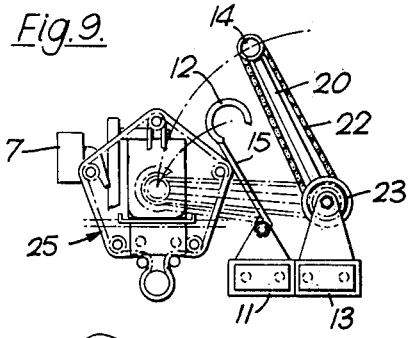

Continuing movement of the pusher 12 pushes the chicken further forwards off the end of the table 1 and through the means 25 onto the table 30. The chicken carries with it the bag and the flap of the bag tears to enable the bag to leave the wicket. The fingers 26 of the means 25 are in their position shown in dotted lines on FIG. 8 when the chicken is pushed through the middle of them. The second pusher 14 moves through the middle of the first pusher 12 with the arm 20 moving through the slot in the pusher 12 and stops adjacent the rear of the chicken 6. The table 1 moves backwards towards its rearmost position and the first pusher 12 moves rearwards. Once the pusher 12 is free of the second pusher 14 it pivots upwards out of the path of the table 1 so that it does not interfere with the flap 4. The driving wheel 29 of the means 25 is rotated and this causes the fingers 26 to move towards the centre and so bring the open end of the bag into contact with the sides of the body 17 of the second pusher 14. The pressing means 25 is shown cut away in FIGS. 5 and 6 to show this position of the bag more clearly. After the sides of the bag have been pressed into contact with the pusher 14 a suction is applied through the pipe 24 and this sucks air from within the bag. This causes the bag to engage the sides of the pusher 14 more closely and also it makes the bag closely conform to the shape of the chicken. Whilst this is happening the jaws 31 move together to hold the chicken 6 on the table 30. Once most of the air has been removed from the bag the motor 23 is operated to rotate the body 17 of the second pusher 14. This closes the bag by twisting its neck. The bag grippers 32 then move together to clamp the twisted neck of the bag and the jaws 31 release the bagged chicken. The bag grippers remove the bagged chicken to a remote station at which a bag tie formed of adhesive tape is fixed to the twisted neck of the bag to seal the bag. This adhesive tape tie may be similar to that described in our copending Application Ser. No. 6834/75. The second pusher 14 then moves backwards and the arm 20 is pivoted upwards so that the second pusher 14 is clear of the table 1 and its flap 4, and the first pusher 12 as the second pusher returns to its initial position. Meanwhile the table 1 has returned to its initial position and has been loaded with a subsequent chicken so that the packaging cycle may be repeated.

I claim:

1. A machine for inserting objects into bags comprising a holder for a stack of bags, an object support movable back and forth between a forward position in which, in use, it is inserted together with an object supported on it, into a bag, and a retracted position, carriage means, first and second pushers mounted on said carriage means, the first pusher being operable to engage said object on said object support and push said object forwards from said object support and at the same time cause said bag to move forwards from said holder, said carriage means also being arranged subsequently to withdraw said first pusher, means for advancing said second pusher into the mouth of the bag, means for pressing said bag inwards into contact with said second pusher behind said object, a suction connection associated with said second pusher for sucking air from said bag after said bag has been pressed into contact with said second pusher, and means for closing said bag after said bag has had said air sucked from it.

2. The machine of claim 1, wherein said second pusher is rotatable and said carriage means includes a rotary drive, the arrangement being such that after said suction connection sucks air from said bag said rotary drive rotates said second pusher and with it the neck of said bag to twist and close said neck of said bag.

3. The machine of claim 1, wherein said support includes a member extending above and fixed to said support, a flap, the front edge of said flap resting on said support adjacent its front edge, and means pivotally connecting the rear edge of said flap and said member.

4. The machine of claim 1, wherein said means for pressing said bag inwards into contact with said second pusher behind said object includes at least three fingers, said fingers being movable into and out of the path of said object whereby, after said object has been moved between them, said fingers move inwards to press said bag into contact with said second pusher.

5. The machine of claim 1, which includes an air nozzle directed towards said stack of bags whereby, in use, a blast of air from said nozzle partially inflates and opens the top bag of said stack to allow said object and said support to be inserted into said top bag.

6. The machine of claim 2, which further includes a pair of jaws located in front of said means for pressing said bag inwards, said jaws being arranged to hold the bagged product while said second pusher is rotated.

* * * * *